US007358901B2

(12) United States Patent
Eberhardt et al.

(10) Patent No.: US 7,358,901 B2
(45) Date of Patent: Apr. 15, 2008

(54) ANTENNA SYSTEM AND APPARATUS

(75) Inventors: Paul Eberhardt, Encinitas, CA (US); Vince Salazar, San Diego, CA (US)

(73) Assignee: Pulse-LINK, Inc., Carlsbad, CA (US)

( * ) Notice: Subject to any disclaimer, the term of this patent is extended or adjusted under 35 U.S.C. 154(b) by 227 days.

(21) Appl. No.: 11/254,148

(22) Filed: Oct. 18, 2005

(65) Prior Publication Data

US 2007/0085743 A1 Apr. 19, 2007

(51) Int. Cl.
*H01Q 1/38* (2006.01)

(52) U.S. Cl. ..... 343/700 MS; 343/846

(58) Field of Classification Search ..... 343/700 MS, 343/846, 828, 795, 797
See application file for complete search history.

(56) References Cited

U.S. PATENT DOCUMENTS

| | | | | |
|---|---|---|---|---|
| 6,351,246 | B1 | 2/2002 | McCorkle | |
| 6,559,810 | B2 | 5/2003 | McCorkle | |
| 6,587,540 | B1 | 7/2003 | Johnson et al. | |
| 6,590,545 | B2 | 7/2003 | McCorkle | |
| 6,842,141 | B2 | 1/2005 | Suh et al. | |
| 6,845,253 | B1 | 1/2005 | Schantz | |
| 6,914,573 | B1 | 7/2005 | McCorkle | |
| 7,075,483 | B2 * | 7/2006 | Okado | 343/700 MS |
| 7,098,856 | B2 * | 8/2006 | Okado | 343/702 |
| 7,187,329 | B2 * | 3/2007 | Okado | 343/700 MS |
| 7,190,320 | B2 * | 3/2007 | Okado | 343/806 |
| 7,209,089 | B2 * | 4/2007 | Schantz | 343/787 |
| 2003/0210207 | A1 | 11/2003 | Suh | |
| 2005/0059348 | A1 | 3/2005 | Chae et al. | |
| 2005/0062670 | A1 | 3/2005 | Suh | |
| 2005/0146471 | A1 | 7/2005 | Kwon et al. | |
| 2005/0151693 | A1 | 7/2005 | Schantz | |
| 2005/0156788 | A1 | 7/2005 | Lin | |
| 2005/0162332 | A1 | 7/2005 | Schantz | |
| 2005/0168394 | A1 | 8/2005 | Kurashima et al. | |
| 2006/0055619 | A1 * | 3/2006 | Sarabandi et al. | 343/866 |

OTHER PUBLICATIONS

Dr. Seong-Youp Suh & Dr. Warren L. Stutzman, Coplanar PICA Antenna, Virginaia Tech Antenna Group, www.vtip.org/licensing/disclosures/00-130.htm, 1 page, date is not available.

(Continued)

*Primary Examiner*—Tan Ho
(74) *Attorney, Agent, or Firm*—Peter Martinez

(57) ABSTRACT

An antenna design is provided. In one embodiment, the antenna is a planar element with a radiating element containing an elliptical curved portion connected to two curved regions, the curved regions meeting at a geometric construct. Another embodiment provides an antenna constructed with intersecting planar elements. A third embodiment is an antenna that is a solid of revolution of a planar element. Some antenna embodiments include ground plane elements to shape the radiation patterns. This Abstract is provided for the sole purpose of complying with the Abstract requirement rules that allow a reader to quickly ascertain the subject matter of the disclosure contained herein. This Abstract is submitted with the explicit understanding that it will not be used to interpret or to limit the scope or the meaning of the claims.

24 Claims, 8 Drawing Sheets

OTHER PUBLICATIONS

Dr. Seong-Youp Suh, Novel Printed Ultra-wideband Antennas, Intel Corporation, Apr. 16, 2004, 35 pages.

Joseph A. N. Noronha et al., Designing Antennas for UWB systems, Penton Media, Inc., Jun. 2003, 6 pages.

Yongxi Qian et al., A Unniplanar Quasi-Yagi Antenna with Wide Bandwidth and Low Mutual Coupling Characteristics, IEEE 1999, 4 pages.

N. K. Nikolova et al., Accelerated Gradient Based Optimization Using Adjoint Sensitivities, Natural Sciences & Engineering Research Council of Canada & Bandler Corp, 31 pages, date is not available.

Nagula Sangary & Natalia K. Nikolova, Line-Of-Sight Approximation to the Equivalence Principle, Ontario, Canada, 24 pages, date is not available.

Dr. Seong-Youp Suh, A Comprehensive Investigation of New Planar Wideband Antennas, Blacksburg, Virginia, Jul. 29, 2002, 245 pages.

* cited by examiner

ANTENNA SYSTEM AND APPARATUS

FIELD OF THE INVENTION

The present invention generally relates to antennas. More particularly, the invention concerns an antenna for wireless communications.

BACKGROUND OF THE INVENTION

The Information Age is upon us. Access to vast quantities of information through a variety of different communication systems are changing the way people work, entertain themselves, and communicate with each other.

For example, because of the 1996 Telecommunications Reform Act, traditional cable television program providers have now evolved into full-service providers of advanced video, voice and data services for homes and businesses. A number of competing cable companies now offer cable systems that deliver all of the just-described services via a single broadband network.

These services have increased the need for bandwidth, which is the amount of data transmitted or received per unit time. More bandwidth has become increasingly important, as the size of data transmissions has continually grown. Applications such as in-home movies-on-demand and video teleconferencing demand high data transmission rates. Another example is interactive video in homes and offices.

Other industries are also placing bandwidth demands on Internet service providers, and other data providers. For example, hospitals transmit images of X-rays and CAT scans to remotely located physicians. Such transmissions require significant bandwidth to transmit the large data files in a reasonable amount of time. These large data files, as well as the large data files that provide real-time home video are simply too large to be feasibly transmitted without an increase in system bandwidth. The need for more bandwidth is evidenced by user complaints of slow Internet access and dropped data links that are symptomatic of network overload.

In addition, the wireless device industry has recently seen unprecedented growth. With the growth of this industry, communication between different wireless devices has become increasingly important. Conventional radio frequency (RF) technology has been the predominant technology for wireless device communication for decades.

Conventional RF technology employs continuous carrier sine waves that are transmitted with data embedded in the modulation of the sine waves' amplitude or frequency. For example, a conventional cellular phone must operate at a particular frequency band of a particular width in the total frequency spectrum. Specifically, in the United States, the Federal Communications Commission (FCC) has allocated cellular phone communications in the 800 to 900 MHz band. Generally, cellular phone operators divide the allocated band into 25 MHz portions, with selected portions transmitting cellular phone signals, and other portions receiving cellular phone signals.

Another type of inter-device communication technology is ultra-wideband (UWB). One type of UWB wireless technology employs discrete pulses of electromagnetic energy and is fundamentally different from conventional carrier wave RF technology. UWB can employ a "carrier free" architecture, which does not require the use of high frequency carrier generation hardware, carrier modulation hardware, frequency and phase discrimination hardware or other devices employed in conventional frequency domain communication systems.

One feature of this type of UWB is that a UWB signal, or pulse, may occupy a very large amount of RF spectrum, for example, generally in the order of Giga-Hertz of frequency band. Currently, the FCC has allocated the RF spectrum located between 3.1 Giga-Hertz and 10.6 Giga-Hertz for UWB communications. The FCC has also mandated that UWB signals, or pulses must occupy a minimum of 500 Mega-Hertz of RF spectrum.

Developers of UWB communication devices have proposed different architectures, or communication methods for ultra-wideband devices. In one approach, the available RF spectrum is partitioned into discrete frequency bands. A UWB device may then transmit signals within one or more of these discrete sub-bands. Alternatively, a UWB communication device may occupy all, or substantially all, of the RF spectrum allocated for UWB communications.

UWB is one form of wireless communications technology that requires extremely large bandwidth. Reliable transmission and reception of wireless UWB signals therefore requires antennas that can radiate and receive across a very wide band of frequencies. With the development of UWB communications, and the continual deployment of new devices that use larger bandwidth carrier wave technology, a need exists for a reliable antenna that can transmit and receive communication signals over a very wide band of radio frequencies.

SUMMARY OF THE INVENTION

The present invention provides an antenna for wireless communications. The antenna herein described is ideal for broadband communications such as ultra-wideband communications. A planar antenna is provided in one embodiment of the present invention. The planar element has a lower elliptical curve that is connected on the two sides to two curves. The two curves terminate in a geometric construct. The planar antenna additionally includes a curved ground plane element. In another embodiment a pair of similar planar elements are provided. In this embodiment the pair of planar elements intersect each other. In this embodiment, a curved ground plane is additionally provided. In a third embodiment an antenna comprising a solid radiating element is provided. These and other features and advantages of the present invention will be appreciated from review of the following detailed description of the invention, along with the accompanying figures in which like reference numerals are used to describe the same, similar or corresponding parts in the several views of the drawings.

BRIEF DESCRIPTION OF THE DRAWINGS

Various embodiments of the present invention taught herein are illustrated by way of example, and not by way of limitation, in the figures of the accompanying drawings, in which.

Figure 1:
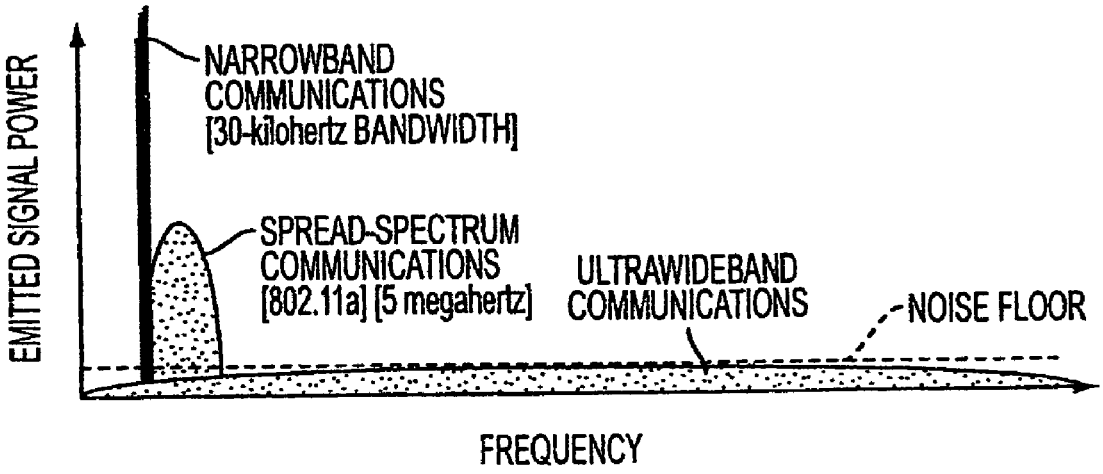
FIG. 1 is an illustration of different communication methods.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE INVENTION

In the following paragraphs, the present invention will be described in detail by way of example with reference to the attached drawings. While this invention is capable of embodiment in many different forms, there is shown in the drawings and will herein be described in detail specific embodiments, with the understanding that the present disclosure is to be considered as an example of the principles of the invention and not intended to limit the invention to the specific embodiments shown and described. That is, throughout this description, the embodiments and examples shown should be considered as exemplars, rather than as limitations on the present invention. Descriptions of well known components, methods and/or processing techniques are omitted so as to not unnecessarily obscure the invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

Unless defined otherwise, all technical and scientific terms used herein have the same meaning as is commonly understood by one of skill in the art to which this invention belongs. In event the definition in this section is not consistent with definitions elsewhere, the definitions set forth in this section will control.

The present invention provides an antenna for wireless communications. In one embodiment, the antenna is designed for operation in the 3.1-10.6 GHz range. One feature of the present invention is that it provides a modified omni-directional radiation pattern. The shape of the ground plane improves the radiation pattern over that of a flat ground plane.

Figure 2:
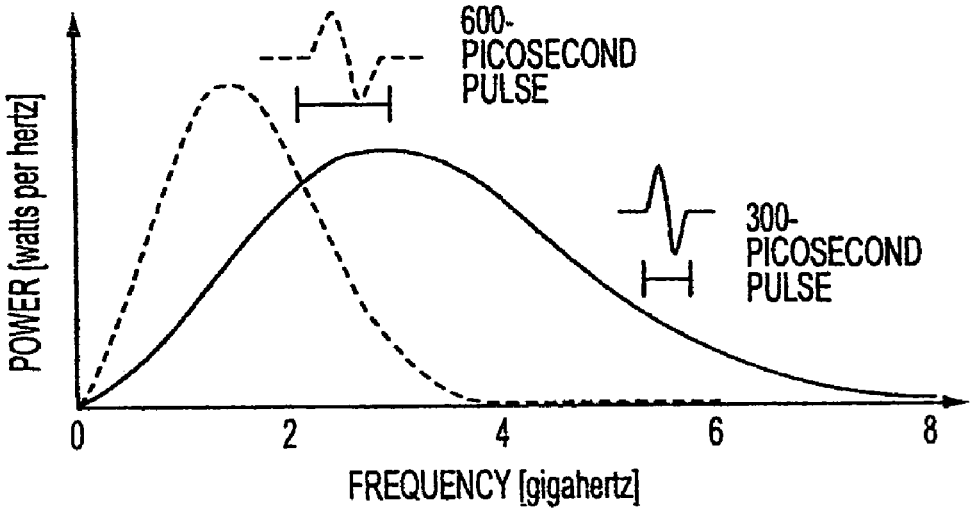
FIG. 2 is an illustration of two ultra-wideband pulses.

The embodiments of the present invention discussed below may be used with ultra-wideband communication technology. Referring to FIGS. 1 and 2, impulse-type ultra-wideband (UWB) communication employs discrete pulses of electromagnetic energy that are emitted at, for example, nanosecond or picosecond intervals (generally tens of picoseconds to a few nanoseconds in duration). For this reason, this type of ultra-wideband is often called "impulse radio." That is, impulse type UWB pulses may be transmitted without modulation onto a sine wave, or a sinusoidal carrier, in contrast with conventional carrier wave communication technology. Impulse type UWB may operate in virtually any frequency band and in some applications may not require the use of power amplifiers.

An example of a conventional carrier wave communication technology is illustrated in FIG. 1. IEEE 802.11a is a wireless local area network (LAN) protocol, which transmits a sinusoidal radio frequency signal at a 5 GHz center frequency, with a radio frequency spread of about 5 MHz. As defined herein, a carrier wave is an electromagnetic wave of a specified frequency and amplitude that is emitted by a radio transmitter in order to carry information. The 802.11 protocol is an example of a carrier wave communication technology. The carrier wave comprises a substantially continuous sinusoidal waveform having a specific narrow radio frequency (5 MHz) that has a duration that may range from seconds to minutes.

In contrast, an ultra-wideband (UWB) pulse may have a 2.0 GHz center frequency, with a frequency spread of approximately 4 GHz, as shown in FIG. 2, which illustrates two typical impulse UWB pulses. FIG. 2 illustrates that the shorter the UWB pulse in time, the broader the spread of its frequency spectrum. This is because bandwidth is inversely proportional to the time duration of the pulse. A 600-picosecond UWB pulse can have about a 1.8 GHz center frequency, with a frequency spread of approximately 1.6 GHz and a 300-picosecond UWB pulse can have about a 3 GHz center frequency, with a frequency spread of approximately 3.3 GHz. Thus, UWB pulses generally do not operate within a specific frequency, as shown in FIG. 1. Either of the pulses shown in FIG. 2 may be frequency shifted, for example, by using heterodyning, to have essentially the same bandwidth but centered at any desired frequency. And because UWB pulses are spread across an extremely wide frequency range, UWB communication systems allow communications at very high data rates, such as 100 megabits per second or greater.

Several different methods of ultra-wideband (UWB) communications have been proposed. For wireless UWB communications in the United States, all of these methods must meet the constraints recently established by the Federal Communications Commission (FCC) in their Report and Order issued Apr. 22, 2002 (ET Docket 98-153). Currently, the FCC is allowing limited UWB communications, but as UWB systems are deployed, and additional experience with this new technology is gained, the FCC may revise its current limits and allow for expanded use of UWB communication technology.

The FCC April 22 Report and Order requires that UWB pulses, or signals occupy greater than 20% fractional bandwidth or 500 megahertz, whichever is smaller. Fractional bandwidth is defined as 2 times the difference between the high and low 10 dB cutoff frequencies divided by the sum of the high and low 10 dB cutoff frequencies. Specifically, the fractional bandwidth equation is:

$$\text{Fractional Bandwidth} = 2\frac{f_h - f_l}{f_h + f_l}$$

where $f_h$ is the high 10 dB cutoff frequency, and $f_l$ is the low 10 dB cutoff frequency.

Figure 3:
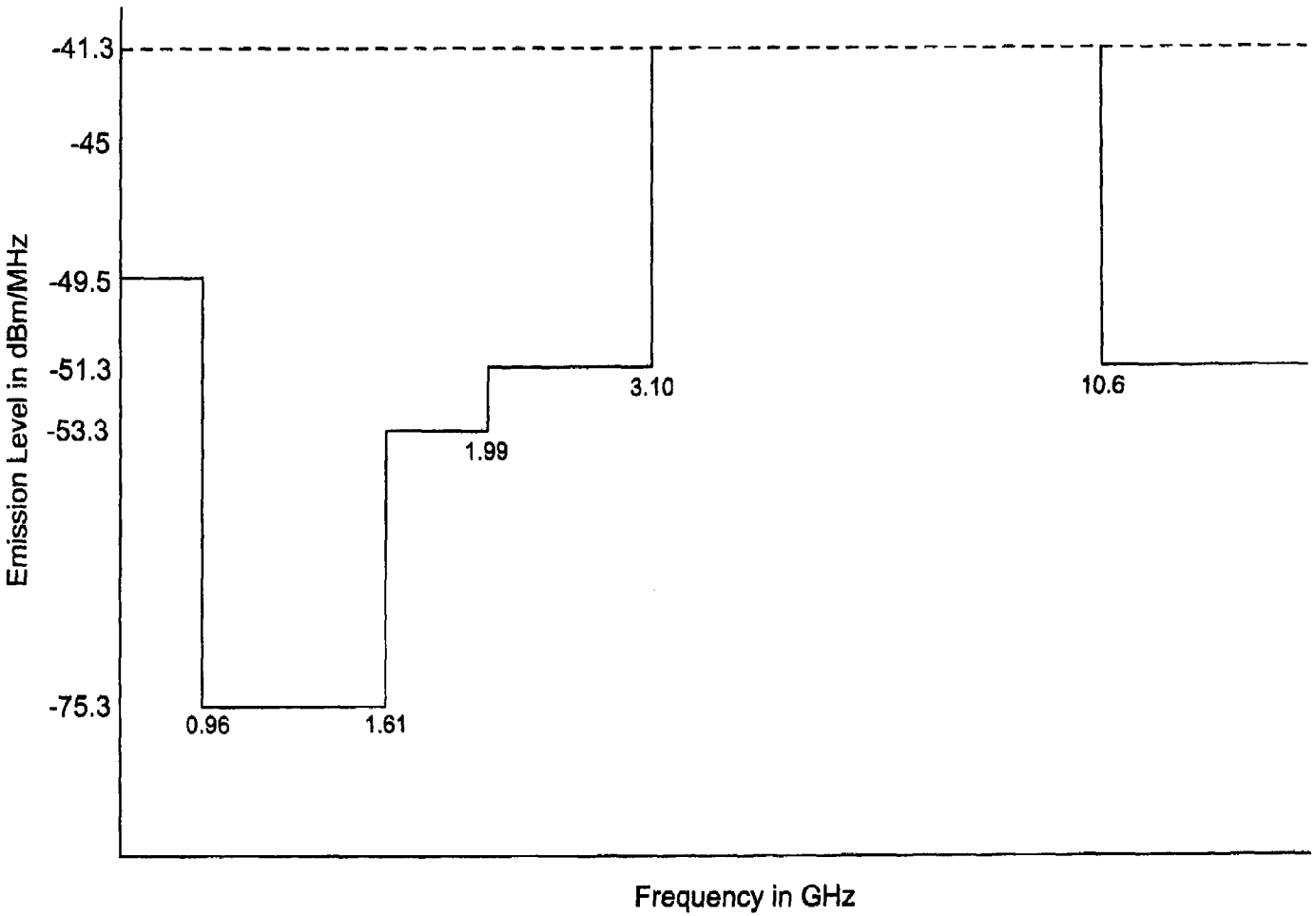
FIG. 3 depicts the current United States regulatory mask for outdoor ultra-wideband communication devices.

Stated differently, fractional bandwidth is the percentage of a signal's center frequency that the signal occupies. For example, a signal having a center frequency of 10 MHz, and a bandwidth of 2 MHz (i.e., from 9 to 11 MHz), has a 20% fractional bandwidth. That is, center frequency, $f_c=(f_h+f_l)/2$ FIG. 3 illustrates the ultra-wideband emission limits for indoor systems mandated by the April 22 Report and Order. The Report and Order constrains UWB communications to the frequency spectrum between 3.1 GHz and 10.6 GHz, with intentional emissions to not exceed-41.3 dBm/MHz. The report and order also established emission limits for hand held UWB systems, vehicular radar systems, medical imaging systems, surveillance systems, through-wall imaging systems, ground penetrating radar and other UWB systems. It will be appreciated that the invention described herein may be employed indoors, and/or outdoors, and may be fixed, and/or mobile, and may employ either a wireless or wire media for a communication channel.

Additionally, the International Telecommunications Union Task Group 1/8 (ITU-TG 1/8) is currently debating ITU recommendations for UWB communications. In some countries the regulations adopted for UWB communications will differ from the FCC definition, but should be similar in nature. For example, the Japanese Ministry of Internal Affairs and Communications (MIC) is currently debating the allowance of UWB in Japan. In this debate one proposal is to allow UWB communications in two frequency bands, one from 3.4 GHz to 4.8 GHz, the other from 7.25 GHz to 10.6 GHz. ITU proposals submitted by the European Conference of Postal and Telecommunications Administration (CEPT) would allow UWB transmission only above 6 GHz. A definition of UWB therefore may not be limited to specific frequency bands.

Generally, in the case of wireless communications, a multiplicity of UWB signals may be transmitted at relatively low power density (milliwatts per megahertz). However, an alternative UWB communication system, located outside the United States, may transmit at a higher power density. For example, UWB pulses may be transmitted between 30 dBm to -50 dBm.

Communication standards committees associated with the International Institute of Electrical and Electronics Engineers (IEEE) are considering a number of ultra-wideband (UWB) wireless communication methods that meet the constraints established by the FCC. One UWB communication method may transmit UWB pulses that occupy 500 MHz bands within the 7.5 GHz FCC allocation (from 3.1 GHz to 10.6 GHz). In one embodiment of this communication method, UWB pulses have about a 2-nanosecond duration, which corresponds to about a 500 MHz bandwidth. The center frequency of the UWB pulses can be varied to place them wherever desired within the 7.5 GHz allocation. In another embodiment of this communication method, an Inverse Fast Fourier Transform (IFFT) is performed on parallel data to produce 122 carriers, each approximately 4.125 MHz wide. In this embodiment, also known as Orthogonal Frequency Division Multiplexing (OFDM), the resultant UWB pulse, or signal is approximately 506 MHz wide, and has approximately 242-nanosecond duration. It meets the FCC rules for UWB communications because it is an aggregation of many relatively narrow band carriers rather than because of the duration of each pulse.

Another UWB communication method being evaluated by the IEEE standards committees comprises transmitting discrete UWB pulses that occupy greater than 500 MHz of frequency spectrum. For example, in one embodiment of this communication method, UWB pulse durations may vary from 2 nanoseconds, which occupies about 500 MHz, to about 133 picoseconds, which occupies about 7.5 GHz of bandwidth. That is, a single UWB pulse may occupy substantially all of the entire allocation for communications (from 3.1 GHz to 10.6 GHz).

Yet another UWB communication method being evaluated by the IEEE standards committees comprises transmitting a sequence of pulses that may be approximately 0.7 nanoseconds or less in duration, and at a chipping rate of approximately 1.4 giga pulses per second. The pulses are modulated using a Direct-Sequence modulation technique, and is known in the industry as DS-UWB. Operation in two bands is contemplated, with one band is centered near 4 GHz with a 1.4 GHz wide signal, while the second band is centered near 8 GHz, with a 2.8 GHz wide UWB signal. Operation may occur at either or both of the UWB bands. Data rates between about 28 Megabits/second to as much as 1,320 Megabits/second are contemplated.

Another method of UWB communications comprises transmitting a modulated continuous carrier wave where the frequency occupied by the transmitted signal occupies more than the required 20 percent fractional bandwidth. In this method the continuous carrier wave may be modulated in a time period that creates the frequency band occupancy. For example, if a 4 GHz carrier is modulated using binary phase shift keying (BPSK) with data time periods of 750 picoseconds, the resultant signal may occupy 1.3 GHz of bandwidth around a center frequency of 4 GHz. In this example, the fractional bandwidth is approximately 32.5%. This signal would be considered UWB under the FCC regulation discussed above.

Thus, described above are four different methods of ultra-wideband (UWB) communication. It will be appreciated that the present invention may be employed by any of the above-described UWB methods, or others yet to be developed. One characteristic of UWB communications is the bandwidth occupied by UWB signals is very large. This characteristic makes it difficult to design antennas that have good radiation patterns and are well suited to large bandwidths. Additionally, there are other forms of communications that can benefit from antennas with these same characteristics. Although the antennas herein provided may be employed in any type of wireless communications network, one embodiment of the present invention provides a UWB network wherein at least one UWB device within the network is equipped with an antenna as herein described.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention.

Figure 4:
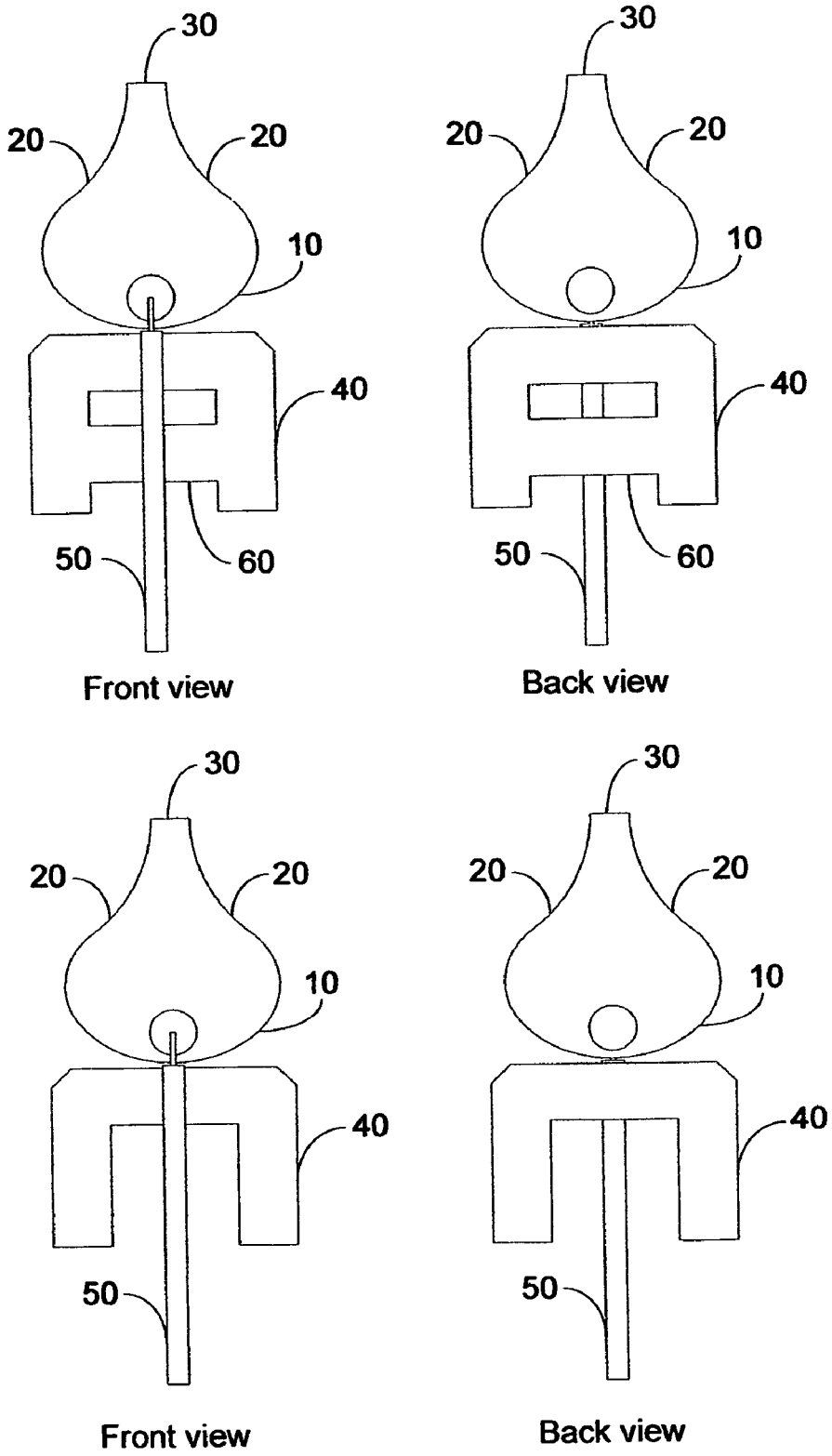
FIG. 4 illustrates planar antennas constructed according to one embodiment of the present invention.
Figure 5:
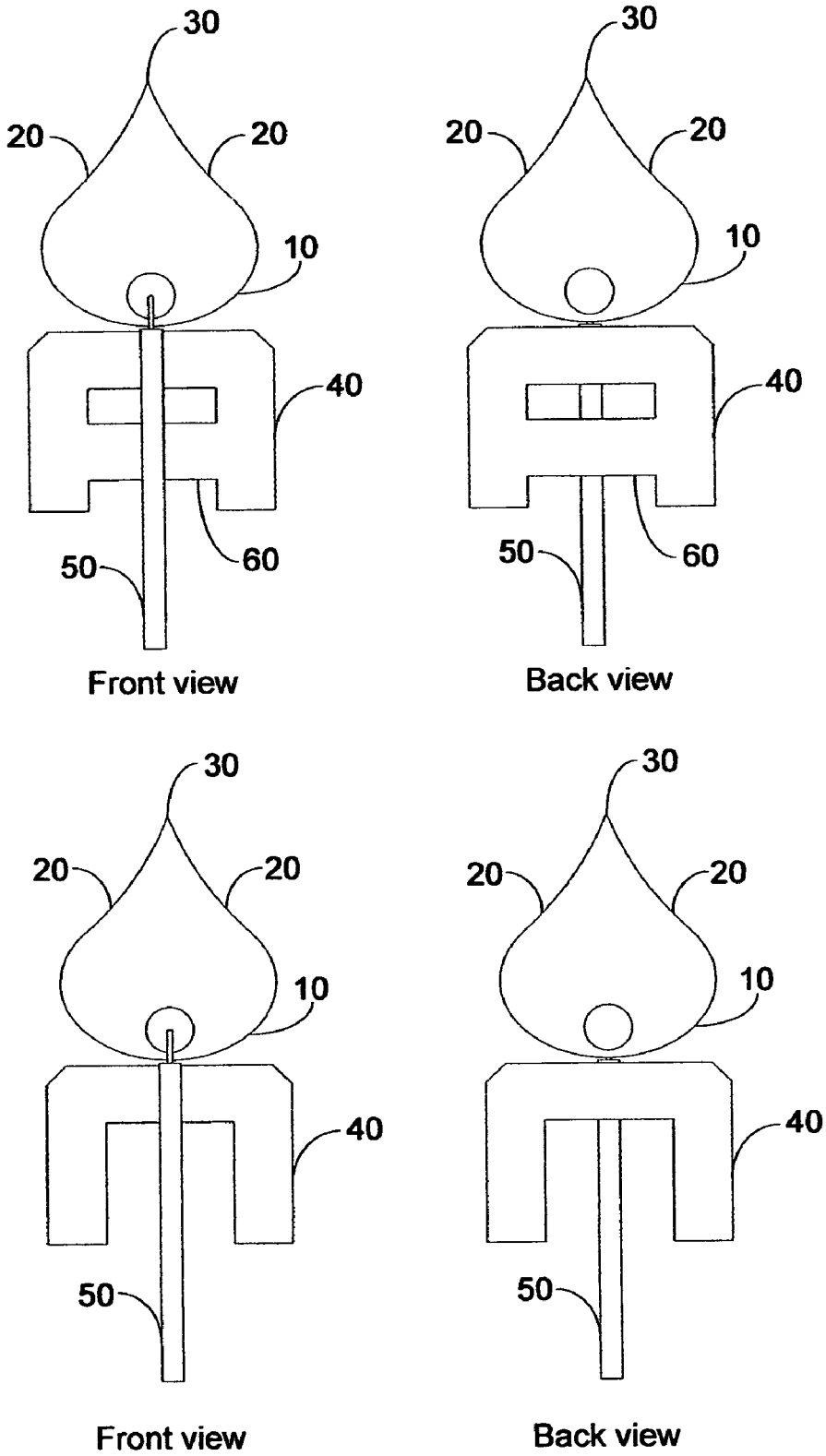
FIG. 5 illustrates planar antennas constructed according to another embodiment of the present invention.

According to one embodiment of the invention, illustrated in FIGS. 4 and 5, a planar antenna is provided for high bandwidth technologies such as UWB. It is important to note that the use of the antennas provided by the present invention is not limited to UWB. The antenna of this embodiment comprises a radiating element with an elliptical curved portion 10. The elliptical curve is connected to two curves 20 that connect at a geometric construct 30. One feature of this embodiment is that it provides an antenna with a good frequency response in the frequency range for UWB. One advantage of this embodiment is that the planar antenna may be fabricated on a printed circuit board. Additionally, flexible materials are known in the art and may be used to practice the invention. The geometric construct 30 connecting the two curves 20 may be a line, a curve or a point. Additionally, the two curves 20, may be described by elliptical functions, conical functions, exponential functions, fractal functions, or higher order polynomial functions.

A ground plane element 40 is added to the radiating element. In one embodiment the ground plane element 40 is shaped similarly to an inverted English letter "U." Ground plane element 40 may have curved edges. One advantage of this embodiment of the present invention is that the shape of the ground plane element 40, shapes the radiation pattern to provide a small gain relative to an isotropic radiation pattern. This embodiment provides a toroidal or "doughnut shaped" radiation pattern in the azimuth plane. This toroidal shape provides for a few decibel dB gain, typically 1-5 dB, relative to an isotropic radiation pattern by limiting the radiation above and below the antenna and focusing the radiation into the toroid.

In another embodiment the ground plane additionally contains a cross bar element 60. In this embodiment the ground plane element 40 resembles the English letter "A." The cross bar element 60 may have linear or curved (not shown) boundaries. The cross bar element 60 may be positioned, relative to the radiating element, such that such that reflection on the feed line 50 is minimized.

Figure 6:
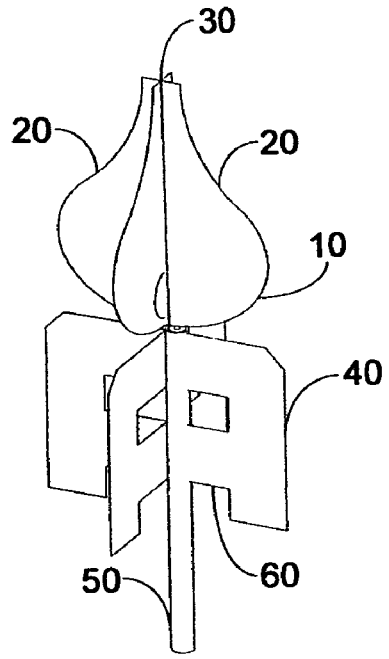
FIG. 6 illustrates intersecting plane antennas constructed according to one embodiment of the present invention.
Figure 6:
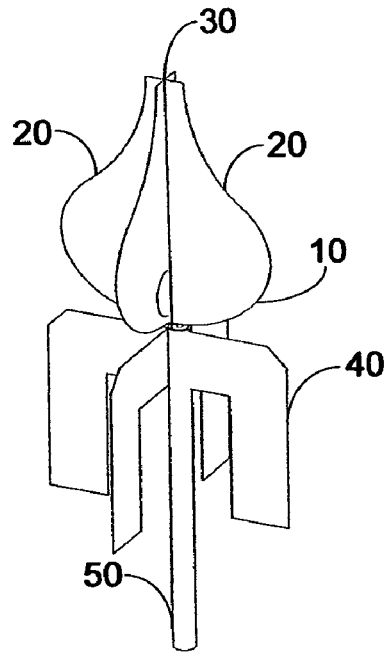
Figure 7:
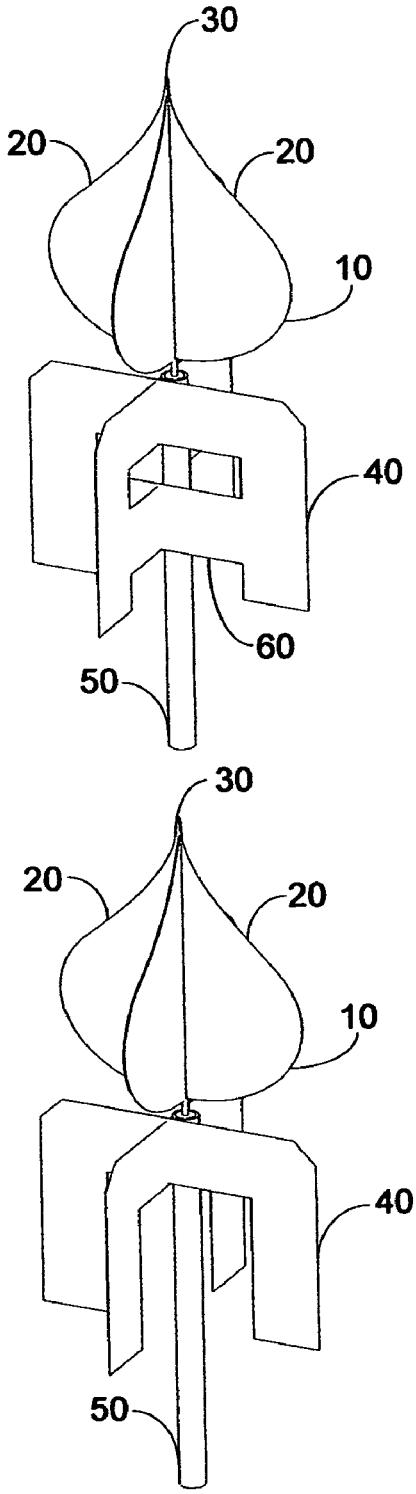
FIG. 7 illustrates intersecting plane antennas constructed according to another embodiment of the present invention.

Another embodiment of the present invention, illustrated in FIGS. 6 and 7, provides an antenna with intersecting planar elements. The planar elements may be similar to the one described above. In some embodiments there are two planar elements intersecting at a right angle, as shown in FIG. 5. In other embodiments there may be additional planar elements including an antenna with 3 intersecting planar elements, an antenna with 4 intersecting planar elements. It will be appreciated that any number of intersecting planar elements may be used to practice the current invention. One feature of these embodiments is that by increasing the number of planar elements used, the shape radiation pattern may be controlled to give a smoother coverage area of radiation.

In one embodiment of the present invention each of the intersecting planar elements may be similar to those described above, each having an elliptical curved section 10 connecting to two curves 20 that connect at a geometric construct 30. One feature of this embodiment is that it provides an antenna with a good frequency response in the frequency range for UWB. The geometric construct 30 connecting the two curves 20 of each intersecting plane may be intersecting substantially flat lines, a pair of curved lines, or a point. Additionally, the two curves 20 may be described by elliptical functions, conical functions, exponential functions, fractal functions, or higher order polynomial functions.

A ground plane element 40 is added to the each of the radiating elements. In one embodiment each ground plane element 40 is shaped similarly to an inverted English letter "U." Ground plane elements 40 may have curved edges. One advantage of this embodiment of the present invention is that the shape of ground plane elements 40, shapes the radiation pattern to provide a small gain relative to an isotropic radiation pattern. This embodiment provides a toroidal or "doughnut shaped" radiation pattern in the azimuth plane. This toroidal shape provides for a few decibel dB gain, typically 1-5 dB, relative to an isotropic radiation pattern by limiting the radiation above and below the antenna and focusing the radiation into the toroid.

In another embodiment the ground plane elements 40 additionally contain a cross bar element 60. In this embodiment each of the ground plane elements 40 resembles an English letter "A." The cross bar elements may be positioned, relative to the radiating element, such that such that reflection on the feed line 50 is minimized. One feature of this embodiment is that providing an increasing number of intersecting planar elements the radiation pattern becomes smoother with the addition of each planar element. One limitation of this embodiment is that three-dimensional antennas, such as the ones described in this embodiment, may be limited in their use to access points, or other fixed infrastructure in a network rather than use in mobile devices.

Figure 8:
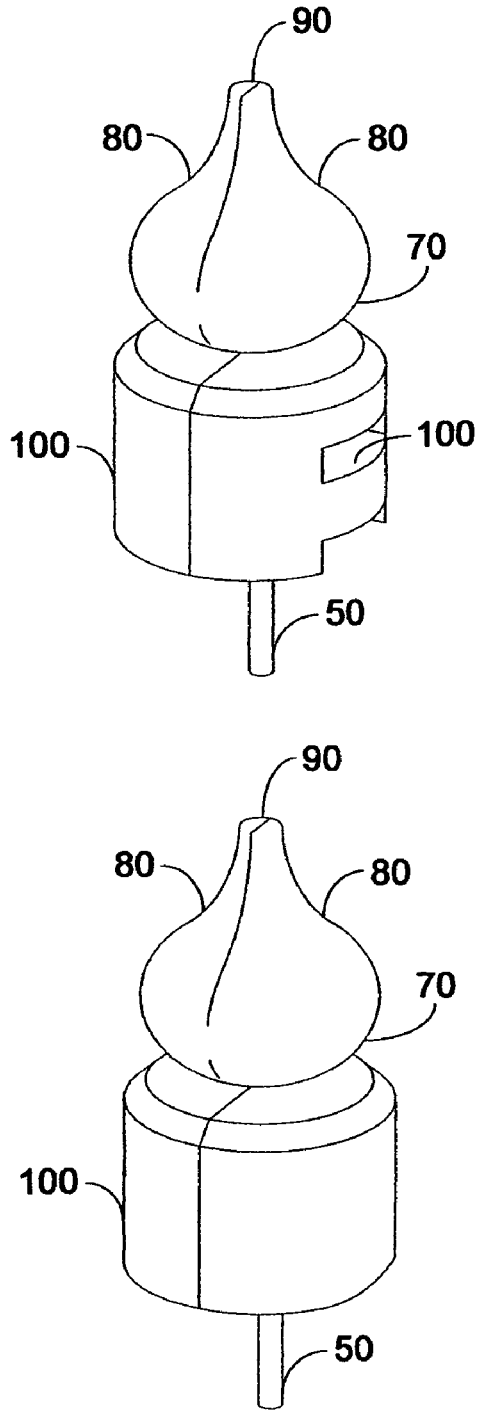
FIG. 8 illustrates solid of revolution antennas constructed according to one embodiment of the present invention.
Figure 9:
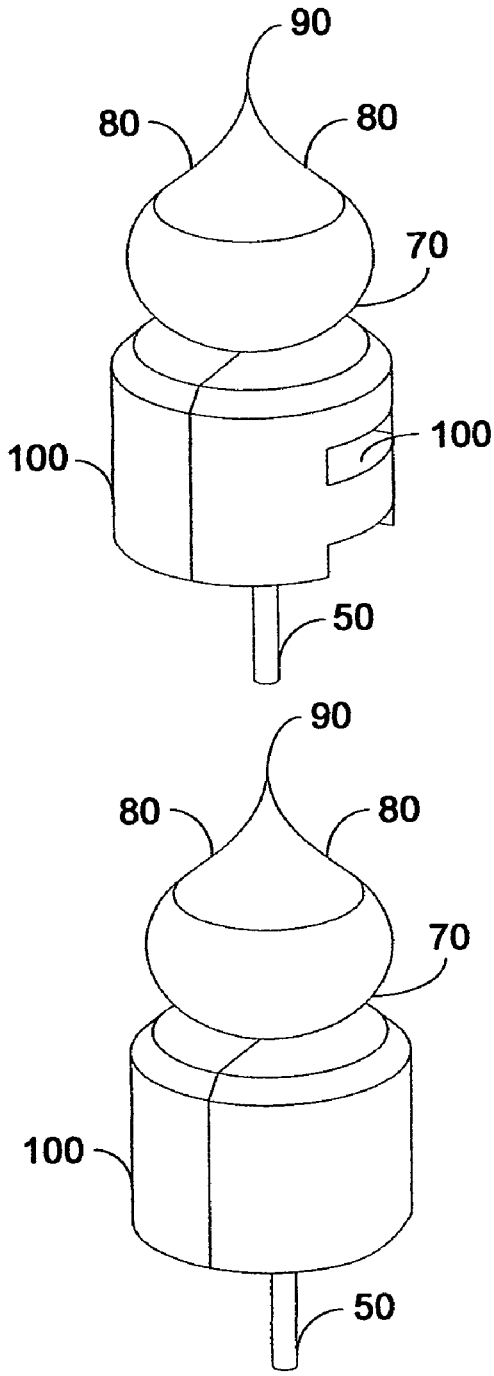
FIG. 9 illustrates solid of revolution antennas constructed according to another embodiment of the present invention.

In another embodiment, illustrated in FIGS. 8 and 9, a solid antenna is provided. The solid antenna may be described by rotating a planar element about a center axis. This embodiment provides for a superior radiation pattern but may be limited in some applications because of its three dimensional nature. In this embodiment, the ground plane may be a hollow three-dimensional curved solid. Alternatively, the ground plane may contain portions of the solid that are not complete. It may contain additional crossbar elements within the solid. Like the other embodiments, the shape and position of the ground plane are selected to minimize reflection on the feed line.

In one embodiment of the present invention a three dimensional radiating element is provided. The three dimensional radiating element has a lower portion 70 that may be described by rotating an elliptical curve around about a center axis. The lower portion 70 is connected to a curved surface 80 that may be described by rotating a curve about a center axis. The curved surface 80 terminates in a geometric construct 90.

A solid ground plane element 100 is added to the radiating element. In one embodiment the solid ground plane element 100 may be described by rotating an inverted English letter "U" about a center axis. The geometric construct 90 terminating the curved surface 80 may be a substantially flat plane surface, a curved surface, a pair of intersecting substantially flat lines, a pair of intersecting curved lines, and a point. Additionally, the curved surface 80 may be described by rotating elliptical functions, conical functions, exponential functions, fractal functions, or higher order polynomial functions about a center axis.

In one embodiment the ground plane element 100 is not completely solid and may contain a cross bar element. The cross bar element may be positioned, relative to the radiating element, such that such that reflection on the feed line 50 is minimized. One feature of this embodiment is that providing solid radiating element the radiation pattern becomes smoother and more uniform. One limitation of this embodiment is that three-dimensional antennas, such as the ones described in this embodiment, may be limited in their use to access points, or other fixed infrastructure in a network rather than use in mobile devices.

One feature of the present invention is that the antennas herein described provide coverage areas that are mostly omni-directional. Having an omni-directional antenna is desirable in some hand-held communications devices since antenna patterns that are directional in nature may require multiple antenna elements, or dead-zones of limited coverage. Both of these results are impractical in hand-held communication device applications. Additionally, the antennas provided by the present invention may be manufactured to be relatively small and lightweight, making them ideal for hand-held communications devices. The antennas provided by the present invention may additionally be used in fixed communications infrastructure.

Thus, it is seen that novel antennas are provided. The antennas are suitable for a wide range of applications including UWB communications. One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. An antenna apparatus, comprising:

a planar radiating element having a lower elliptical curve connected to a right and a left curve, the right and left curves joined at a geometric construct and at a ground plane, with the ground plane substantially U-shaped.

2. The apparatus of claim 1, wherein the geometric construct is selected from a group consisting of a line, a curve, and a point.

3. The apparatus of claim 1, wherein the left and the right curves represent functions selected from a group consisting of: elliptical functions, conical functions, exponential functions, fractal functions, and polynomial functions.

4. The apparatus of claim 1, wherein the ground plane has curved edges.

5. The apparatus of claim 1, further comprising a crossbar element attached to the ground plane.

6. The apparatus of claim 5, wherein the crossbar element is selected from a group consisting of: a crossbar element having a linear boundary, and a crossbar element having a curved boundary.

7. The apparatus of claim 5, further comprising a feed line attached to the planar radiating element and the ground plane.

8. The apparatus of claim 7, wherein the crossbar element is positioned to minimize reflection along the feed line.

9. The apparatus of claim 1, wherein the ground plane is shaped similarly to a capital letter A.

10. An antenna apparatus, comprising:

a first planar radiating element having a lower elliptical curve connected to a right and a left curve, the right and left curves joined at a geometric construct;

a second planar radiating element having a lower elliptical curve connected to a right and a left curve, the right and left curves joined at the geometric construct; and a ground plane, the ground plane substantially U-shaped.

11. The apparatus of claim 10, wherein the geometrical construct is selected from a group consisting of: a substantially flat plane surface, a curved surface, a pair of intersecting substantially flat lines, a pair of intersecting curved lines, and a point.

12. The apparatus of claim 10, wherein the left and the right curves of the first and second planar radiating elements represent functions selected from a group consisting of: elliptical functions, conical functions, exponential functions, fractal functions, and polynomial functions.

13. The apparatus of claim 10, wherein the ground plane has curved edges.

14. The apparatus of claim 10, further comprising a crossbar element attached to the ground plane.

15. The apparatus of claim 14, wherein the crossbar element is selected from a group consisting of: an intersecting pair of elements with linear boundaries, and an intersecting pair of elements with curved boundaries.

16. The apparatus of claim 10 further comprising a feed line attached to the first and second planar radiating elements and the ground plane.

17. The apparatus of claim 16, wherein the crossbar element is positioned to minimize reflection along the feed line.

18. The apparatus of claim 10, wherein the ground plane is shaped similarly to a pair of intersecting capital letter "A"s.

19. An antenna apparatus, comprising:

a solid radiating element described by rotating a planar element about an axis, the planar element having a lower elliptical curve connected to a right and a left curve, the right and left curves joined at a geometric construct.

20. The apparatus of claim 19, further comprising a solid ground plane element described by rotating a planar element about an axis, the planar element substantially U-shaped.

21. The apparatus of claim 20, wherein the geometrical construct is selected from a group consisting of: a substantially flat plane surface, a curved surface, a pair of intersecting substantially flat lines, a pair of intersecting curved lines, and a point.

22. The apparatus of claim 20, further comprising a feed line connected to the solid radiating element and the solid ground plane element.

23. The apparatus of claim 22, further comprising a crossbar element attached to the ground plane, the crossbar element positioned to minimize reflection on the feed line.

24. The apparatus of claim 19, wherein the left and the right curves represent functions selected from a group consisting of: elliptical functions, conical functions, exponential functions, fractal functions, and polynomial functions.

* * * * *